United States Patent [19]

Chen et al.

[11] 4,088,157

[45] May 9, 1978

[54] HOOD SYSTEM FOR COVERING AN AUTOMATICALLY OPERATING MACHINE

[75] Inventors: Yian Nian Chen; Marcel Brügger, both of Winterthur; Friedrich Maurer, Biel; Alfred Meyer, Winterthur, all of Switzerland

[73] Assignee: Sulzer Brothers Ltd., Winterthur, Switzerland

[21] Appl. No.: 693,919

[22] Filed: Jun. 8, 1976

[30] Foreign Application Priority Data

Jun. 12, 1975 Switzerland ..... 7609/75

[51] Int. Cl.[2] ..... D03D 49/00; E04B 1/84; G10K 11/00

[52] U.S. Cl. ..... 139/1 R; 160/23 R; 160/84 R; 181/200; 181/205

[58] Field of Search ..... 139/1 R, 1 C; 66/168; 28/22; 98/115; 181/33 K, 33 G, 33 GB, 200, 205; 160/23 R, 26, 193, 84 R

[56] References Cited

U.S. PATENT DOCUMENTS

| | | | |
|---|---|---|---|
| 983,663 | 2/1911 | White | 160/23 R |
| 1,632,381 | 6/1927 | Peck | 98/115 R |
| 2,268,192 | 12/1941 | Davis et al. | 160/193 |
| 2,915,115 | 12/1959 | Reynolds | 181/33 GB |
| 3,234,996 | 2/1966 | King et al. | 181/33 GB |
| 3,237,682 | 3/1966 | Davis | 160/23 R |
| 3,292,685 | 12/1966 | Clark | 160/26 |
| 3,317,259 | 5/1967 | Otis | 160/23 R |
| 3,378,998 | 4/1968 | Smackerford | 139/1 C |
| 3,627,201 | 12/1971 | Partsch | 139/1 C |
| 3,633,706 | 1/1972 | Kennedy | 139/1 R |
| 3,700,068 | 10/1972 | Francis | 181/33 K |
| 3,741,335 | 6/1973 | Le Beau | 181/33 GB |
| 3,860,085 | 1/1975 | Gilbert et al. | 181/33 K |
| 3,905,444 | 9/1975 | Evans, Jr. | 181/33 K |
| 3,955,347 | 5/1976 | Schippers | 181/33 K |

FOREIGN PATENT DOCUMENTS

| | | | |
|---|---|---|---|
| 937,907 | 3/1948 | France | 181/33 K |
| 970,777 | 10/1958 | Germany | 98/115 R |
| 717,643 | 10/1966 | Italy | 160/84 R |

*Primary Examiner*—James Kee Chi

*Attorney, Agent, or Firm*—Kenyon & Kenyon, Reilly, Carr & Chapin

[57] ABSTRACT

The cover for a weaving machine is formed, in part, of flexible mats of sound-insulating material which can be raised or lowered in the manner of a window shade.

In one embodiment, the rollers on which the flexible mats are mounted are positively driven to raise or lower the mats while a toggle means is used to support the mat over the machine frame. In addition, the rollers are mounted in a carriage which can be moved to one side while the sides of the cover are opened to allow access to the machine from above.

In another embodiment, the flexible mats are in an accordion or pleated form and are raised or lowered via an endless chain.

12 Claims, 8 Drawing Figures

HOOD SYSTEM FOR COVERING AN AUTOMATICALLY OPERATING MACHINE

This invention relates to a hood system for covering an automatically operating machine. More particularly, this invention relates to a sound-insulating hood system for covering a weaving machine.

As is known, various automated machines such as textile machines are provided with covers which shield the machine and which consist of sound-insulating material. For example, use has been made of hoods which can be raised and lowered as a whole or mounted to pivot in the manner of a lid. However, such systems generally require relatively expensive hood lifting and guide means which are usually supported, for example, on the building in which the machines are located. Depending upon the type of machine, these systems may be relatively large and may require a correspondingly large free space above the machine.

Accordingly, it is an object of the invention to provide an easily operated cover which occupies little space and can be used independently of any existing lifting means and other fittings on the building.

It is another object of the invention to provide a sound insulating hood system for a machine which ensures rapid access to the screened zone of the machine with little outlay both when the machine is idle and when the machine is in operation.

Briefly, the invention provides a hood system for covering an automatically operating machine wherein the system comprises at least fixed end frame, and at least one wall section of sound insulating material which is movably mounted relative to the end frame between an operating position with a bottom edge of the wall section near ground level and a stored position with the bottom edge elevated above ground level to provide access to the machine. The system also comprises a pair of rigid guide tracks which slidably receive two side edges of the wall section and means for raising, storing and lowering the wall section within the guide tracks.

In practice, the system allows rapid access to the machine for maintenance or supervision within a few seconds independently of any work which may be performed on other machines.

In one embodiment, the movable wall section consists of a flexible material and the means for raising and lowering the wall section comprises at least one substantially horizontal and rotatably mounted roller which is disposed in the region of the stored position and on which the wall section is fixed so as to be capable of being wound and unwound in the manner of a window shade. In addition, a drive mechanism, such as a drive motor, is used to rotate the roller in order to selectively wind and unwind the wall section. This embodiment is particularly simple and very reliable in operation and ensures both good screening of the machine and smooth and quiet operation of the system.

In another similarly advantageous embodiment of the invention, the movable wall section is divided into a plurality of interconnected segmental strips disposed substantially horizontally and adapted to be brought into contact with one another and a plurality of guide elements. Each of the guide elements is connected to an edge of at least one of the segmental strips and is guidably disposed in the guide tracks. In addition, the means for raising and lowering the wall section includes a drive motor and a traction means connected between the motor and at least one of the guide elements.

The segmental strips may be arranged in the form of a roller blind, i.e. separately of one another, or be interconnected, for example after the style of a bellows.

To ensure access to the machine from above, e.g. for the installation and removal of machine parts, as when a harness is changed in a weaving machine, the raising and lowering means may be mounted on a movable carriage which is guided for displacement on two parallel guide tracks disposed transversely of the movable wall section.

In another development of the invention, a system of a particularly simple and stable construction particularly suitable for covering relatively long textile machines, is characterized in that the movable wall section is part of a cover surrounding the required zone of the machine in the form of a tunnel and the guide tracks are disposed in the region of two substantially fixed end walls which close the cover at each end.

In order to obtain a lightweight construction both for transportation and for assembly and further to improve access to the machine, the system is formed with two end walls which each comprise a torsionally-stiff frame with an at least partially flexible and/or detachable panelling adapted to be fixed thereon.

According to one embodiment of the invention which is particularly advantageous as regards arrangement and function and for operation and maintenance of the machine and the system, when two shade-like wall sections are disposed on either side of the zone of the machine to be covered, two associated raising and lowering means may be disposed side-by-side in a storage zone accommodating the two wall sections above the machine.

Advantageously, to obtain and maintain predetermined operating conditions within the covered space which may, for example, require air-conditioning, at least one part of the end frame of the hood system is formed with a passage for a duct which is adapted to carry air and which connects the zone of the machine requiring screening to an air supply and/or discharge system.

Should the covered machine have a stop mechanism for stopping the machine which is responsive to a malfunction of the machine, e.g. a yarn stop motion of a weaving machine, a switch means can connect the stop mechanism to the raising and lowering means in order to activate this means to move the movable wall section to the stored position in response to stopping of the machine. To this end, a signal may be triggered on stopping of the machine for transmission to the raising and lowering means in order to activate a drive for this means. This allows a reduction in the downtime of the machine should a malfunction occur since the machine zone in which the malfunction occurs is rendered accessible with practically no delay as the movable wall section is then completely raised when the operators, who usually have to attend to a number of machines, come to clear the malfunction on the machine once they have seen that the machine has stopped.

These and other objects and advantages of the invention will become more apparent from the following detailed description and appended claims taken in conjunction with the accompanying drawings in which:

Figure 1:
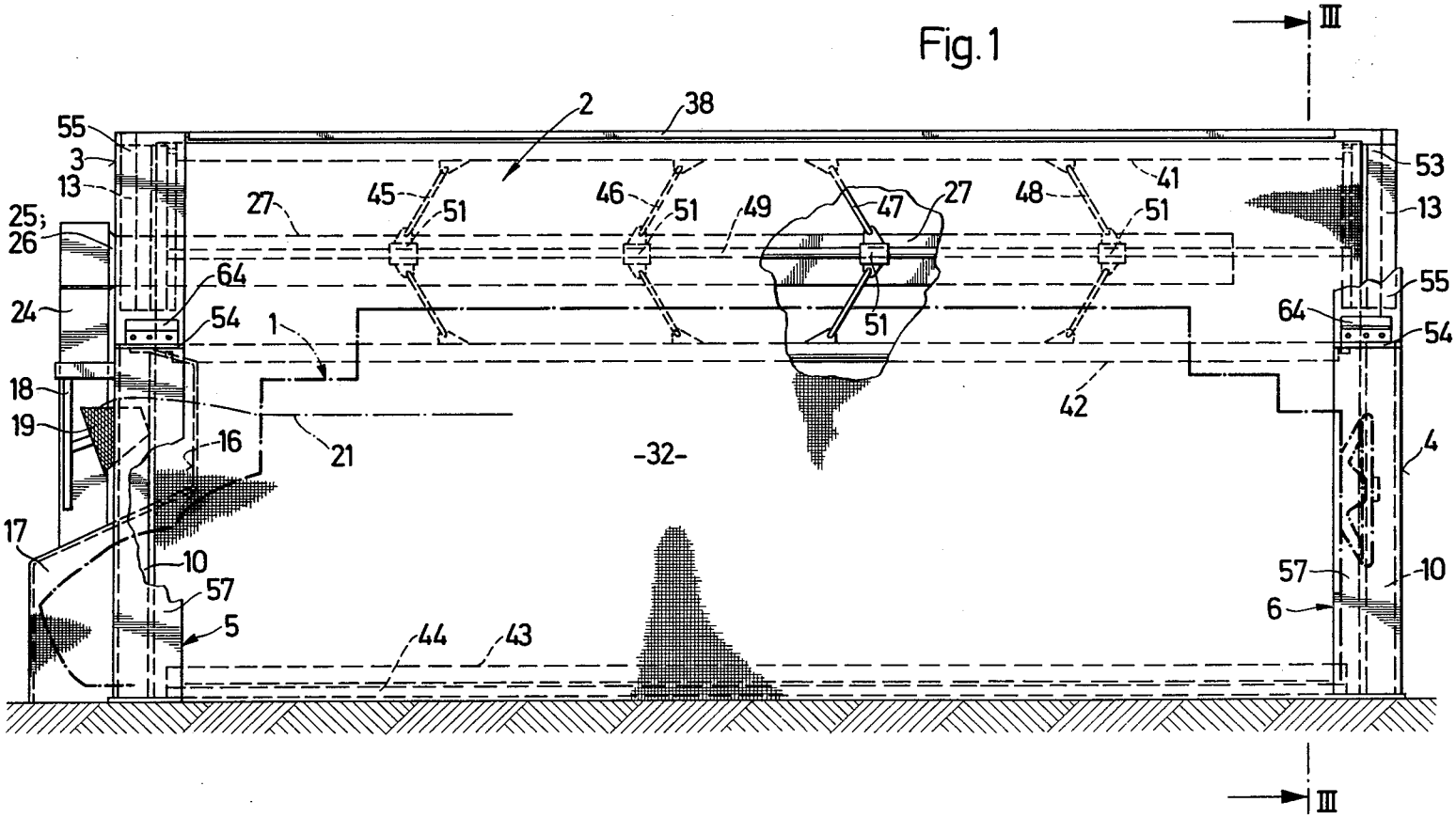
FIG. 1 illustrates a front elevational view of a hood system according to the invention about a weaving machine.
Figure 2:
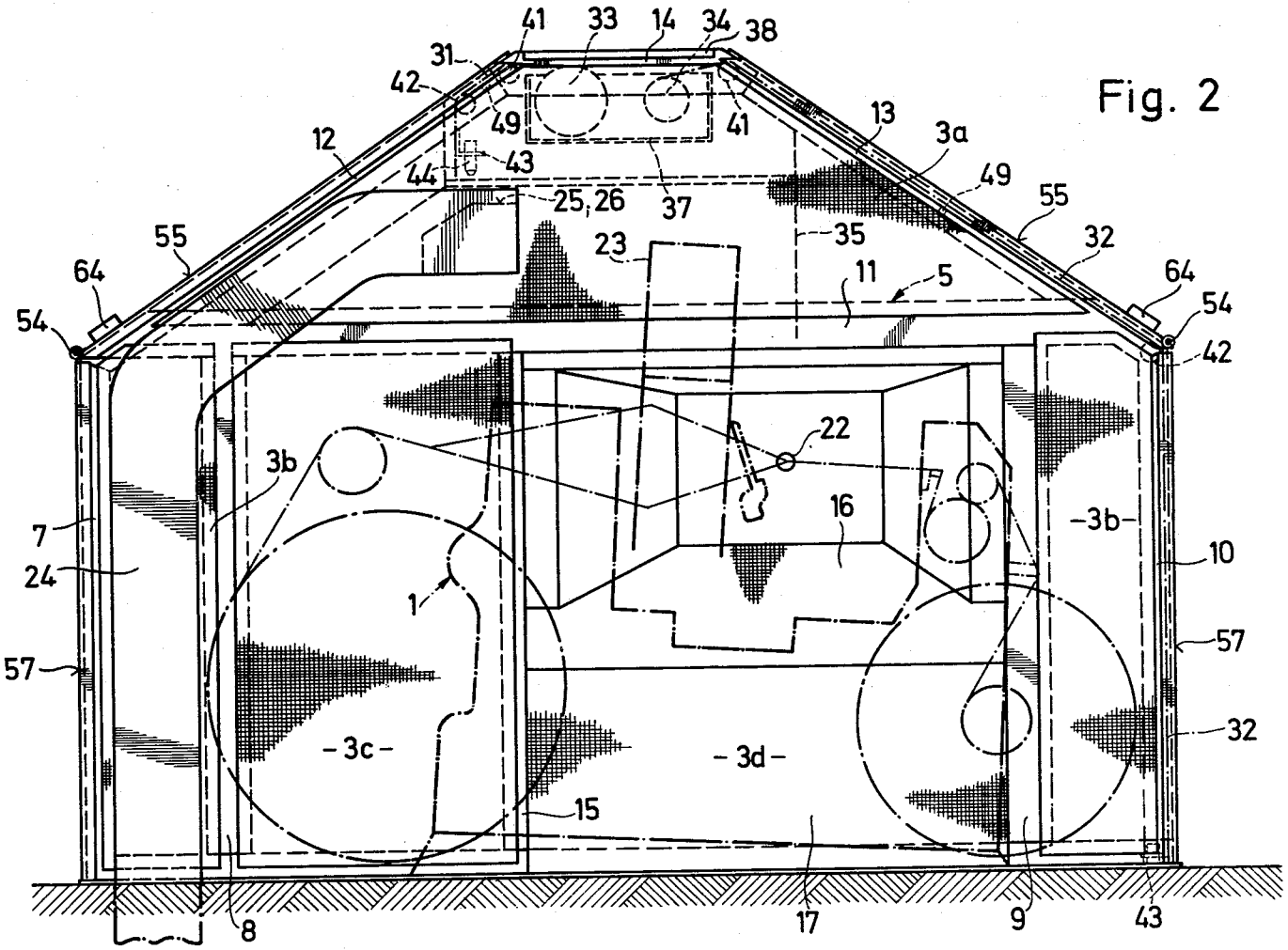
FIG. 2 illustrates a side elevational view of the hood system of FIG. 1.

Referring to FIGS. 1 and 2, an automatically operating machine such as a weaving machine 1, which is shown only in outline and in which a weft yarn supply is mounted outside a shed, is covered by a hood system formed in part of sound-insulating material. The hood system includes a tunnel-like cover 2 which forms a roof over the machine 1 and a pair of end walls 3, 4 which close off the cover and are disposed at opposite ends of the weaving machine 1. The end walls 3, 4 each contain a rigid end frame 5, 6 which is adapted to be secured to a floor of a weaving shop. Each end frame 5, 6 is of roof truss-like construction and is formed of four vertical columns 7, 8, 9, 10, a horizontal beam 11, a pair of inclined struts 12, 13 which are secured to the horizontal beam 11, and a horizontal connecting member 14 which is connected to and between the inclined struts 12, 13. One end frame 5 also contains an additional vertical column 15 (FIG. 1) to support the beam 11. Each end wall 3, 4 also has a plurality of wall panels **3*a*, 3*b*, 3*c*, 3*d*; 4*a*, 4*b*, 4*c*, respectively, of sound insulating material such as plumbo-resinite mats detachably secured to the outside of the frames 5, 6**. For fixing purposes, the panels and the corresponding frame members are provided with matching strips of a Velcro fastener, i.e. a fastener of the hook and pile type. Other fixing means, e.g. press studs or the like, may also be used.

In order to follow the shape of the machine 1, the panel **3*d* fixed to the members 9, 11 and 15 has an indentation 16 and a bulge 17. Two weft yarn supply bobbins 19 (only one visible in the drawing) are fixed on a creel disposed outside the cover in the region of the indentation 16. A weft yarn 21 is drawn from each of the supply bobbins 19 and is fed to the weaving machine 1 through an eyelet 22 in the panel 3*d* so as to be picked. Various parts of a drive mechanism for the shafts which move up and down in the weaving machine 1 project into the bulge, the range of movement 23 of which is indicated by chain-dotted lines in FIG. 2**.

An air duct 24 connected to an air supply system (not shown) extends upwardly along the end wall 3 and is connected via a connecting member 25 to a distribution duct 27 disposed with the cover 2 above the weaving machine 1. The connecting member 25 extends through a passage aperture 26 provided in the wall panel **3*a***.

Figure 3:
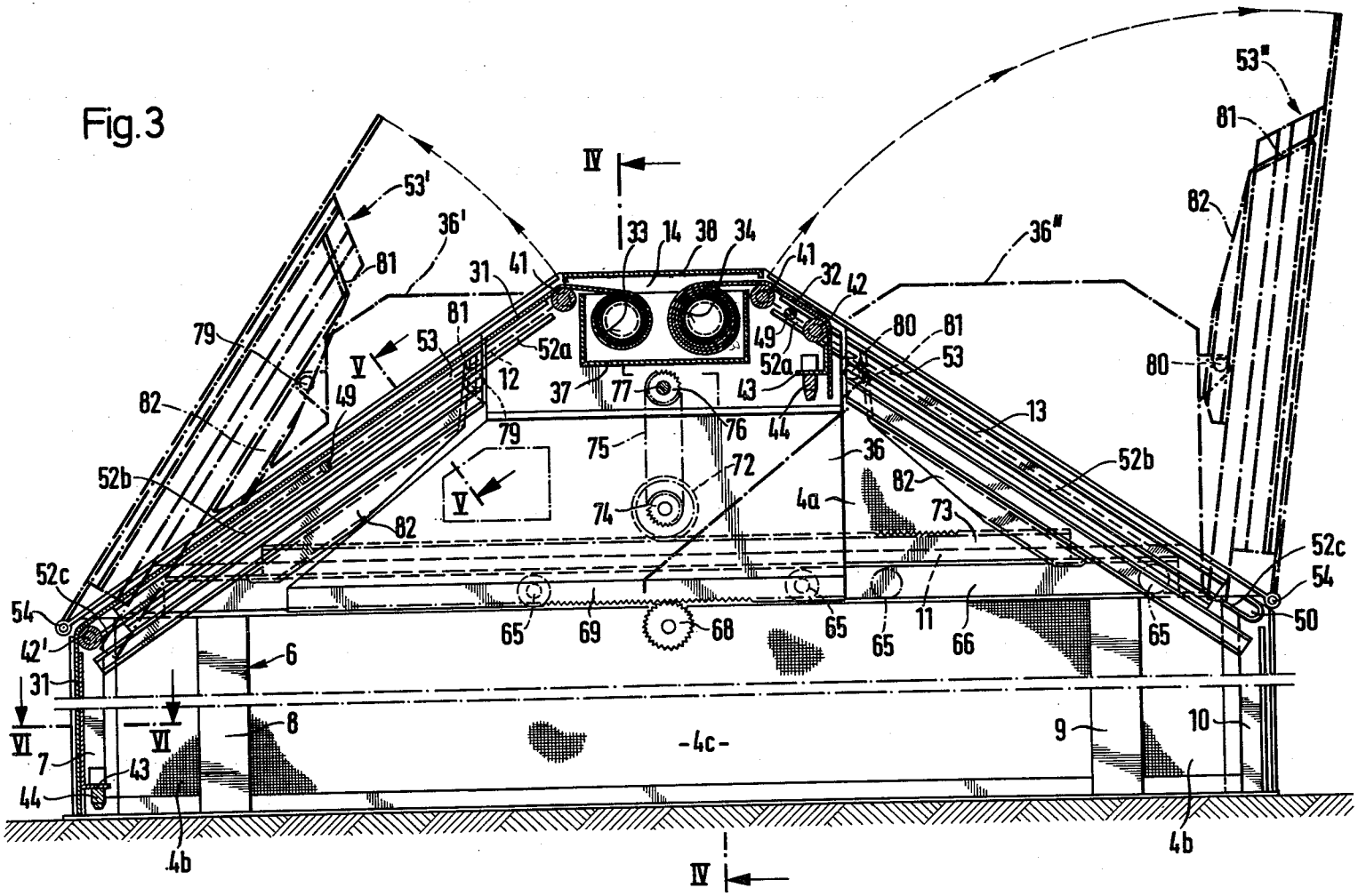
FIG. 3 illustrates a view taken on line III—III of FIG. 1.

Referring to FIGS. 2 and 3, the cover 2 has two side wall sections 31 and 32 which extend over the entire length of the cover 2 and which also each consist of a flexible plumbo-resinite mat. The wall sections 31, 32 are each secured so as to be adapted for winding and unwinding in the manner of a window shade on a horizontal roller 33, 34 respectively disposed above the weaving machine 1 and disposed transversely between the end frames 5, 6.

Figure 4:
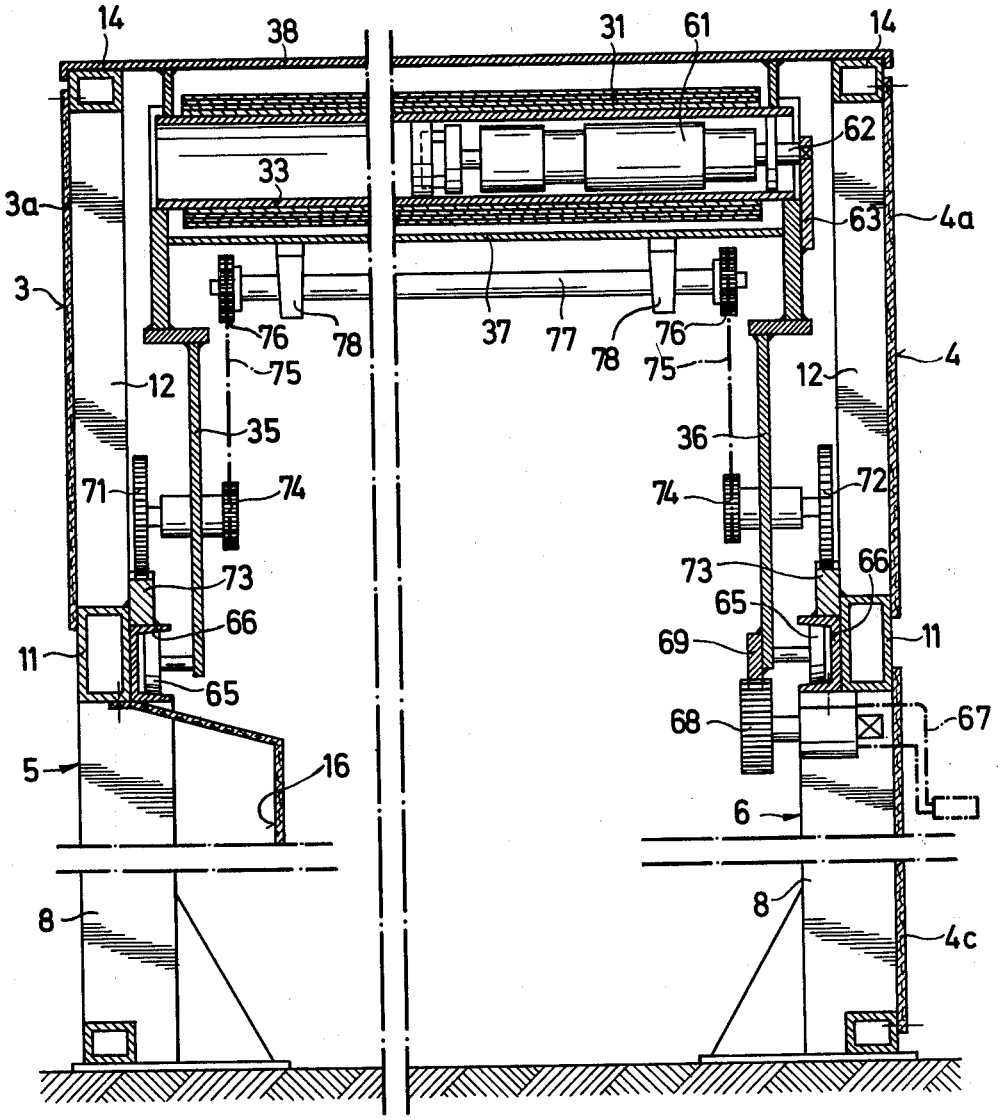
FIG. 4 illustrates a view taken on line IV—IV of FIG. 3.

Referring to FIG. 4, each roller 33, 34 (only one of which is shown for simplicity) is rotatably mounted in a carriage formed of two carriers 35, 36 and a trough-shaped interconnecting member 37 (FIG. 3). In addition, a cover plate 38 extends over the rollers 33, 34 and is fixed to the connecting members 14 of the end frames 5, 6. The carriers 35, 36 are movably guided along the beams 11. As shown, each carrier 35, 36 has a roller 65 which is guided in a channel-shaped rail 66 fixed to the beam 11 of an end frame 5, 6 and a gearwheel 71, 72 which meshes with a toothed rack 73 secured as by welding to a rail 66 and beam 11. The two gearwheels 71, 72 are each connected to a sprocket wheel 74 for common rotation via a common shaft. The sprocket wheels 74, in turn, are connected via an endless chain 75 to a respective sprocket wheel 76 mounted on a common shaft 77 which is rotatably mounted in a plurality of bearings 78 (only two of which are shown). These bearings 78 are mounted in dependent manner from the trough shaped member 37 of the carriage. In addition, a gearwheel 68 adapted to be driven by a hand crank 67 is mounted on the end wall 4 and meshes with a rack 69 fixed on the carrier 36 so that the carriage can be moved along the rails 66.

A reversible drive motor 61 is disposed in each of the rollers 33, 34 and has a housing coupled to the roller barrel so as to rotate therewith while the rotor of the motor 61 is secured against turning by means of a shaft stub 62 which projects from the rollers 33, 34, respectively and which engages, via a square portion formed at the end, in a corresponding recess in a locking plate 63 fixed to the carrier 36.

Referring to FIG. 3, each of the two wall sections 31, 32 extends over a toggle means composed of a fixed deflector rod 41 mounted in the carriers 35, 36, a deflector rod 42 which is movable in parallel relation to the deflector rod 41 and four symmetrically disposed pairs of toggle levers 45, 46, 47, 48 articulated to and between the rods 41, 42 (FIG. 1). The middle joints 51 of each lever is guided for axial displacement on a guide rod 49 disposed between the rods 41. The bottom ends of the two wall sections 31, 32 hang freely over the deflector rods 42 and are each stiffened by an angle section 43, on the underside of which a rubber contact strip 44 is secured.

Figure 6:
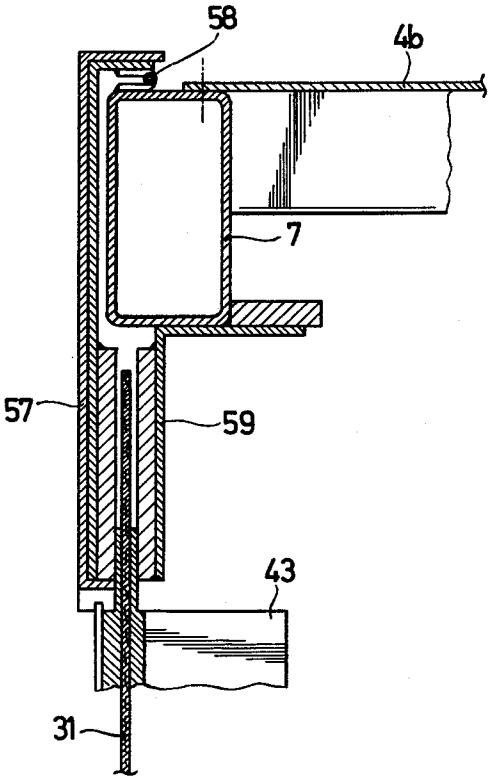
FIG. 6 illustrates a view taken on line VI—VI of FIG. 3 of a lower end of an end frame.
Figure 5:
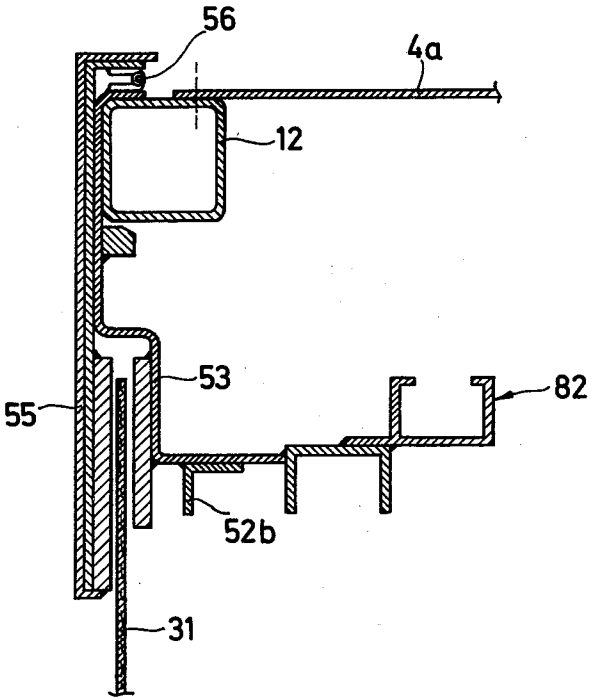
FIG. 5 illustrates a view taken on line V—V of FIG. 3 of a part of the guide tracks for guiding a movable wall section.

The ends of the deflector rods 42 and of the guide rods 49 are guided in lateral guide tracks **52*a*, 52*b*, 52*c* extending along the inclined struts 12, 13 of the end frames 5, 6. The guide tracks 52*a* are formed on the carriers 35, 36 and the guide tracks 52*c* are formed on the columns 7 and 10. The intermediate guide tracks 52*b* are formed on guide rails 53 (FIG. 5) which are each articulated on the top ends of the columns 7 and 10 so as to be pivotable about a horizontal pivot 54 and brought into contact with the inclined struts 13. A cover strip 55 is articulated by hinges 56 to each guide rail 53 (FIG. 5) while corresponding cover strips 57 are articulated on each of the columns 7, 10 by means of hinges 58 (FIG. 6). A vertical guide rail 59 is also fixed to each of the columns 7, 10 (FIG. 6**).

As shown in FIG. 2, two switches 64 for activation of the drive motors 61 for each roller 33, 34 are respectively mounted on the cover strips 55.

As shown in FIG. 3, each of the carriers 35, 36 is provided with two driver pins 79, 80 which are adapted to run on a stop strip 81 provided on the adjacent guide rail 53. Each strip 81 merges into a guide track 82 for the associated driver pin 79, 80.

In the example according to FIG. 3, the wall section 31 is shown in the position in which its bottom edge touches the ground, while the wall section 32 has been wound-up on the roller 34 with its bottom edge held in a stored position above the weaving machine. The deflector rod 42 is held at a small distance from the deflector rod 41 in the region of guide track 52*a* by the angle section 43. The wall section 32 is unrolled by driving the roller 34 in the clockwise direction. In these conditions, the deflector rod 42 follows the downwardly moving angle section 43 under gravity and slides over the guide tracks 52*b* and 52*c* against a stop 50 where the rod 42 is then held in a position 42'. As the wall section 32 is unrolled further, the angle section 43 moves away from the deflector rod 42, which remains in position 42', and is lowered against the floor until the motor 61 is switched off — e.g. by a signal triggered when the contact strip 44 touches the ground. This can be accomplished in any suitable manner, e.g. by a switching system which transmits a break signal to the associated motor 61 when the contact strip 44 encounters resistance. The contact strip 44 is of any conventional structure, for example, the strip may have an air filled rubber hose on the bottom surface which extends along the length of the strip 44. In addition, a contact element which responds to pressure waves is connected to the hose. The contact element is activated when the hose touches an obstacle and an increased air pressure results within the hose. The contact element then releases a disconnect signal for the motor 61 which is transmitted via the switches 64.

The wall section 31 is rolled up by driving the roller 33 in the clockwise direction. In these conditions, the angle section 43 is lifted and guided against the deflector rod 42 resting in the guide track 52*c*. The deflector rod 42 is finally pushed out of position 42' over intermediate guide track 52*b* into guide track 52*a* until reaching the top storage position.

To unwind the wall section 31 and wind the wall section 32, the rollers 33, 34 are driven accordingly in the counterclockwise direction. The lateral edges of the wall sections 31, 32 are each guided in the region of the inclined struts 12, 13 between the guide rail 53 and the cover strip 55 (FIG. 5) and in the region of the columns 7, 10 between the guide rail 59 and the cover strip 57 (FIG. 6). The wall sections 31, 32 are prevented from sagging in the region of the inclined struts 12, 13 by means of the toggle lever pairs 45, 46, 47, 48.

When the two wall sections 31, 32 occupy the top position (stored position) the carriage 35, 36, 37 can be displaced laterally. As a result, the weaving machine 1 can be made accessible from above, for example in the region 23 of the shafts, e.g. for replacement of the latter or the harness. To this end, the gearwheel 68 (FIG. 4) is rotated by means of the hand crank 67 so that the carriage is displaced via the rack 69 from the solid-line position shown in FIG. 3 to either of the chain-dotted position 36', 36'', respectively. In these conditions, the associated guide rails 53 are each pivoted into a corresponding position 53', 53'' by the driver pins 79, 80 first running onto the stop strip 81 and then in the guide track 82. The wall sections 31, 32 cannot be lowered again until the carriage 35–37 and the guide rails 53 again occupy the position shown in solid lines in FIG. 3.

The switches 64 for the motors 61 are connected to a switching system (not shown) which is connected to a weaving machine stop mechanism (not shown) which responds automatically to any malfunction. This switching system transmits a signal which is triggered on stoppage of the machine to switch on the associated motor 61 in the direction of rotation required to wind up the wall sections 31, 32, respectively. In these conditions, either just one motor or both motors 61 can be switched on depending upon the location of the malfunction.

Figure 7:
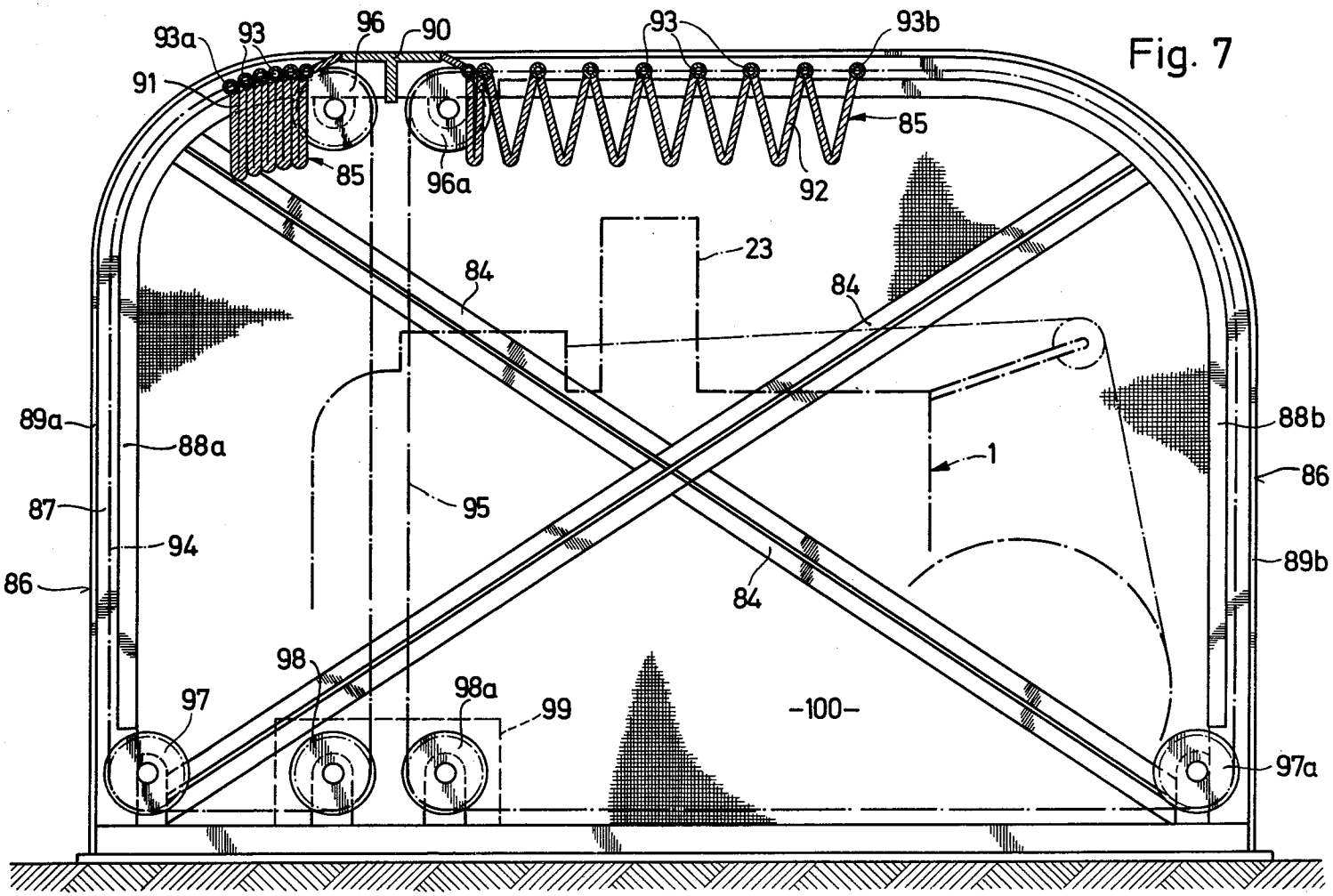
FIG. 7 illustrates a cross-sectional view of a modified hood system according to the invention.

Referring to FIG. 7, the hood system may be constructed in an alternative manner so as to use articulated movable wall sections. As shown, the hood system comprises a cover 85 which surrounds the weaving machine 1 in the form of a tunnel and two end walls 86, only one of which is visible. The end walls 86 each comprise a frame 87 formed from U-shaped members and stiffened by two diagonal struts 84. Each frame 87 is formed with guide tracks 88*a*, 88*b* and lateral cover strips 89*a*, 89*b*. The two frames 87 are connected by an off-center member 90 which leaves free the space above the range of movement 23 of the shafts. In this way, the shafts or the harness can be inserted or replaced from above, e.g. by means of a crane.

The cover 85 is formed by two wall sections 91, 92 of sound-insulating plumbo-resinite mats. Each section 91, 92 is formed of a plurality of segmental strips interconnected by guide elements 93 or of a mat folded bellows-fashion, the upper and outer folds being provided with stiffening and guide elements 93. The ends of the guide elements 93 are guided along the guide tracks 88*a*, 88*b*. The guide elements 93*a*, 93*b* connected to the free end of the wall sections 91, 92 respectively are each connected to an endless chain 94, 95 guided along the associated guide track 88*a*, 88*b*. The endless chains 94, 95 are each guided over a sprocket wheel 96, 96*a* respectively mounted at the top part of the frame 87 and over two sprocket wheels 97, 98; 97*a*, 98*a* respectively mounted near the floor. The sprocket wheels 98, 98*a* are each coupled to a motor of a drive mechanism 99 disposed outside the hood system.

The wall sections 91, 92 are each secured by one end on the member 90 while the end fixed on the rods 93*a*, 93*b* respectively is movable between the top storage position and an operational position near ground level. In order to raise and lower the wall sections 91 and 92, the endless chains 94, 95 are selectively moved in the appropriate direction via the sprocket wheels 98, 98*a*. The frames 87 are also provided with a wall panel 100 of plumbo-resinite mats.

Figure 8:
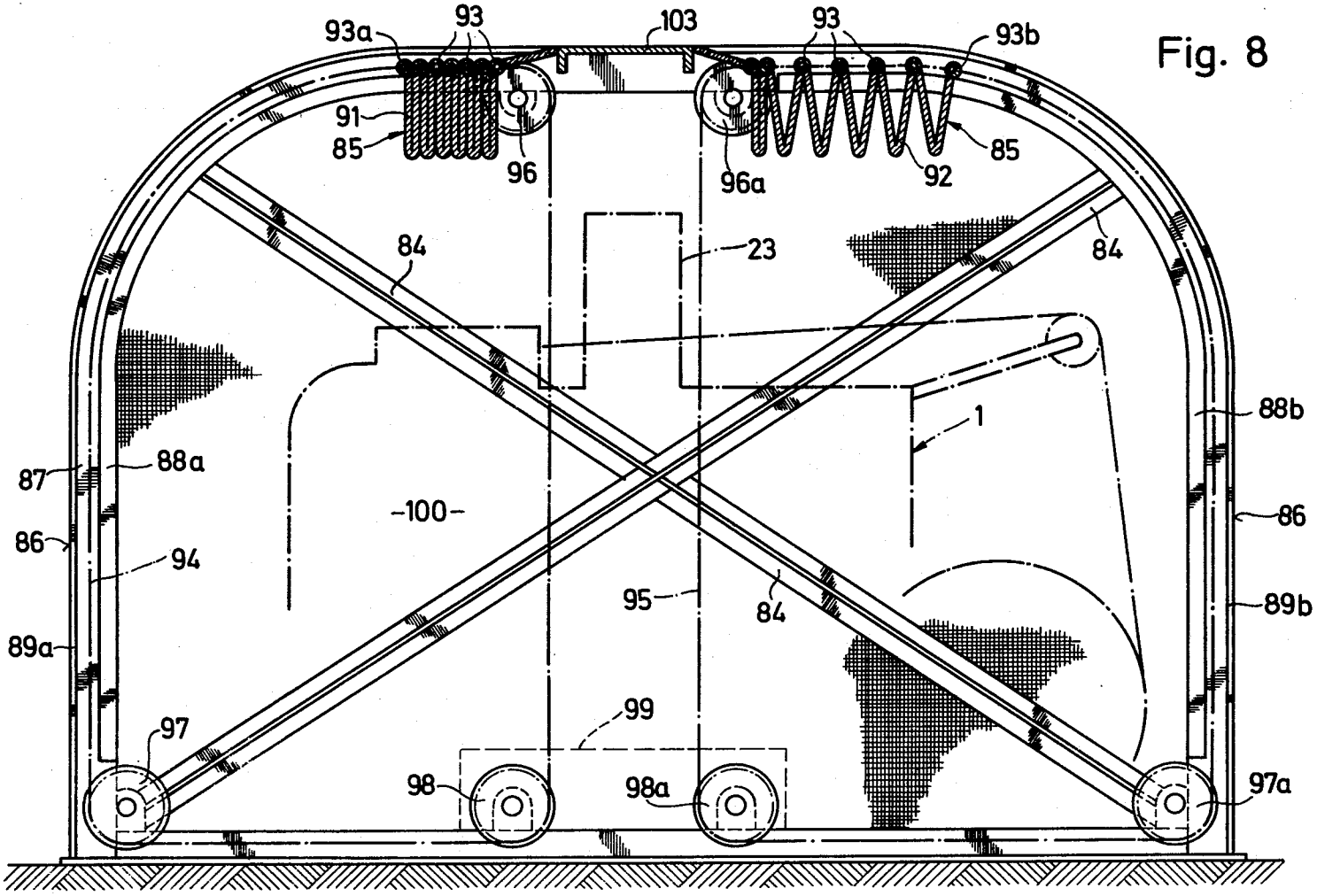
FIG. 8 illustrates a cross-sectional view of a further modified hood system according to the invention.

Referring to FIG. 8, wherein like reference characters indicate like parts as above, the hood system may also be modified so that the two frames 87 are connected by a member 103 disposed substantially in the middle, approximately above the range of movement 23 of the shafts. In this construction, jacquard cords in the case of jacquard weaving machines, for example, can be taken up through the member 103. Also, instead of using endless chains, other traction means may be used, for example ropes or belts.

Various other embodiments of the invention are possible. For example, instead of plumbo-resinite mats it is possible to use sheets of some other sound-insulating material, e.g. based on a mineral basis, or even rigid and just loosely interconnected strips of a suitable material. The subject matter of the invention may also be applied to other machines, e.g. spinning machines, machine tools or the like. Constructions are also possible in which the movable wall sections do not extend over the entire length of the hood, or in which just one of the wall sections is movable.

What is claimed is:

1. A hood system for covering an automatically operating machine comprising a pair of fixed end frames;

a cover for surrounding the machine in the form of a tunnel, said cover having at least one sidewall section of sound insulating material movably mounted relative to said end frames between an operating position with a bottom edge of said wall section near ground level and a stored position with said bottom edge elevated above ground level to provide access to the machine;

a pair of rigid upright guide tracks on said end frames slidably receiving two side edges of said wall section therein; and means for raising, storing and lowering said wall section within said guide tracks.

2. A hood system as set forth in claim 1 wherein said movable wall section is made of flexible material and said means includes at least one horizontal and rotatably mounted roller in said stored position for winding of said wall section thereon and a drive motor for rotating said roller to selectively wind and unwind said wall section.

3. A hood system as set forth in claim 1 wherein said movable wall section is divided into a plurality of interconnected segment strips and a plurality of guide elements, each said guide element being connected to an edge of at least one of said strips and guidably disposed in said guide tracks, and wherein said means includes a drive motor and a traction means connected between said drive motor and at least one of said guide elements.

4. A hood system as set forth in claim 1 which further comprises a pair of parallel guide tracks disposed transversely of said wall section and a carriage movably mounted for movement along said parallel guide tracks and mounting said means thereon.

5. A hood system as set forth in claim 1 wherein said guide tracks are disposed at respective ends of said cover.

6. A hood system as set forth in claim 5 wherein each fixed end wall includes a portionally-stiff frame with an at least partially flexible panelling mounted on said frame.

7. A hood system as set forth in claim 1 which further comprises a pair of said movable wall sections disposed to opposite sides of said frame and a pair of said means for raising, storing and lowering said wall sections, said pair of means being disposed side-by-side in a storage zone for said wall sections above the machine.

8. A hood system as set forth in claim 1 which further comprises a duct communicating with a passage in said end frame for supplying a flow of air into said hood system.

9. In combination with a weaving machine, a hood system for covering said machine, said hood system comprising a pair of upright end frames disposed at opposite ends of said weaving machine;

a cover mounted about said weaving machine in a tunnel-like manner;

said cover having at least one wall section between said end frames of sound insulating material movably mounted in said frames between an operating position with a bottom edge of said wall section near ground level and a stored position with said bottom edge elevated above ground level to provide access to said machine;

a pair of rigid upright guide tracks on said end frames slidably receiving respective side edges of said wall section therein; and means for moving said wall section between said positions.

10. A hood system as set forth in claim 9 wherein said machine includes a stop mechanism responsive to a malfunction of said machine for stopping said machine, and a switch means connecting said stop mechanism to said means for moving said wall section to activate said means to move said wall section to said stored position in response to stopping of said machine.

11. In combination with a weaving machine a hood system for covering said machine, said hood system comprising a pair of upright end frames disposed at opposite ends of said weaving machine, sound-insulating mats detachably fixed to each of said end frames, a pair of rollers disposed transversely between said end frames above said weaving machine, a pair of flexible mats of sound-insulating material, each said mat being secured to a respective roller for winding thereon and unwinding therefrom, toggle means extending transversely between and guided within said end frames, each said toggle means having a respective one of said mats laying thereon, each said toggle means being expandible and collapsible between a closed position and an open position, and means for rotating each said roller to selectively wind and unwind a respective mat thereon between an operating position with a bottom edge of said respective mat near ground level and a stored position with said bottom edge elevated above ground level to provide access to said weaving machine while selectively allowing simultaneous collapsing and expansion of each respective toggle means.

12. In combination with a weaving machine a hood system for covering said machine, said hood system comprising a pair of upright end frames disposed at opposite ends of said weaving machine, sound-insulating mats detachably fixed to each of said end frames, a pair of guideways in each said end frame, a plurality of guide elements extending transversely between said end frames and guided in said respective guideways, a cover for covering said weaving machine, said cover having a pair of parts, each said part including a plurality of segment strips of flexible sound-insulating material connected between said guide elements, a pair of endless chains, each said chain being connected to a respective one of said cover parts, and means for selectively moving each respective chain to raise and lower each said cover part in said end frames.

* * * * *